United States Patent [19]

McIntire

[11] 4,213,567

[45] Jul. 22, 1980

[54] DISCHARGE NOZZLE FOR FLUORINATED HYDROCARBON FIRE SUPPRESSION SYSTEM

[75] Inventor: Ronald A. McIntire, Blue Springs, Mo.

[73] Assignee: Fike Metal Products Corporation, Blue Springs, Mo.

[21] Appl. No.: 968,036

[22] Filed: Dec. 11, 1978

[51] Int. Cl.[2] ..... A62C 31/02

[52] U.S. Cl. ..... 239/396; 169/37

[58] Field of Search ..... 239/390, 396, 505, 524, 239/552, 553; 169/37, 41

[56] References Cited

U.S. PATENT DOCUMENTS

| | | | |
|---|---|---|---|
| 89,456 | 4/1869 | Allen | 239/391 |
| 1,639,162 | 8/1927 | Brooks | 239/390 |
| 2,562,503 | 7/1951 | Meffan | 239/390 |
| 2,884,202 | 4/1959 | Smith | 239/396 X |

*Primary Examiner*—Robert B. Reeves

*Assistant Examiner*—Gene A. Church

*Attorney, Agent, or Firm*—Schmidt, Johnson, Hovey & Williams

[57] ABSTRACT

Nozzle structure particularly adapted for use with pressurized fire suppressants is disclosed which includes an elongated, tubular, apertured body, and a visible, easily replaceable, fluid flow-directing slug disposed therein for controlling and directing lateral fluid flow from the nozzle. The slug is located in partial or complete blocking relationship to certain of the body sidewall apertures so as to define therewith outlet ports of desired effective dimensions and to control the spray patterns emanating therefrom. Use of a slug of different configuration serves to alter nozzle performance, discharge direction and discharge rate without need for any additional modifications of the nozzle. The annular end wall of the body allows the adjacent end face of the slug to be seen, such that appropriate coding can be applied to the slug end face for easy determination of the design discharge rate of the nozzle.

8 Claims, 10 Drawing Figures

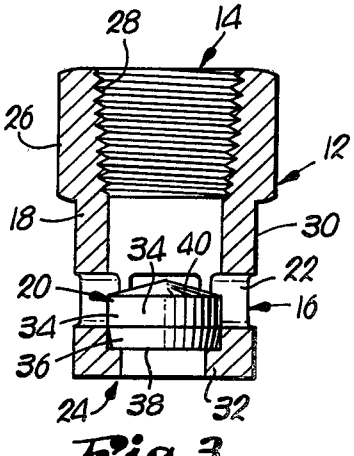
Fig. 3.
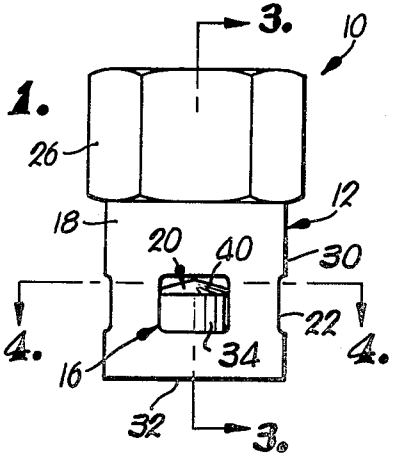
Fig. 1.
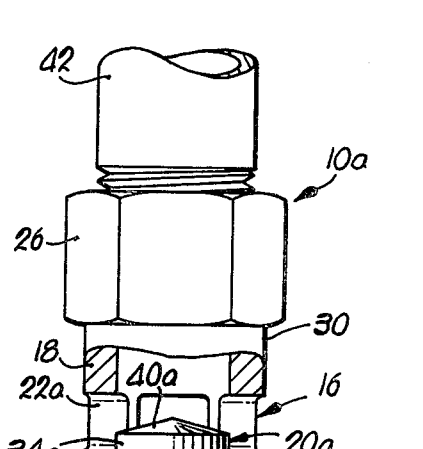
Fig. 5.
Fig. 4.
Fig. 2.
Fig. 6.

DISCHARGE NOZZLE FOR FLUORINATED HYDROCARBON FIRE SUPPRESSION SYSTEM

BACKGROUND OF THE INVENTION

1. Field of the Invention

This invention broadly relates to fluid discharge nozzles, and more particularly to nozzles adapted for use with fire extinguishants such as Halon 1301. A particular feature of the invention stems from the fact that the performance and directional spray characteristics of the nozzle can be easily and quickly altered without the need for extensive modification of the nozzle.

2. Description of the Prior Art

Modern day fire suppression devices incorporated into buildings and the like generally include a supply of an effective fire suppressant (such as Halon 1301) under pressure, means for actuating the unit such as a conventional sealing disc provided with an explosive actuator, and a suppressant delivery system which may include the appropriate piping and ultimate suppressant delivery nozzles. As can be appreciated, the nozzle structures provided with such devices are normally designed to give a predetermined discharge rate of suppressant, as well as an appropriate discharge pattern. In this way, a plurality of nozzles can be employed to effectively cover a given area with an amount of suppressant deemed necessary to meet all contingencies.

Fire regulations demand that such nozzle assemblies be entirely predictable in performance, and moreover in many cases state that a coding for rates of fire extinguishant discharge be visible on the exterior of the nozzle. This is so that the nozzles can be quickly inspected without the need for dismantling thereof.

Many extinguishant nozzles proposed in the past have been characterized by a complicated design, and the inability to easily alter the performance characteristics and discharge rates thereof. Thus, a supplier of extinguishant apparatus has been forced to stock a wide variety of nozzles to meet various needs. Furthermore, requirement of exterior coding on such nozzles has heretofore effectively precluded the possibility of providing nozzle structure which can be altered to meet various conditions. That is to say, the necessary permanent coding, if simply applied to the exterior of a nozzle body, makes it impossible to alter the performance characteristics of the nozzle, because in that event such characteristics would not correspond to the exterior coding.

SUMMARY OF THE INVENTION

The present invention overcomes the difficulties noted above by provision of a simplified fluid discharge nozzle which can be easily and quickly modified to give virtually any desired directional and performance characteristics as well as discharge rates, while at the same time correspondingly and virtually automatically changing the exterior coding information. Broadly, the nozzle comprises an elongated, tubular, apertured body, along with a fluid flow-directing slug disposed within the body and located in at least partial covering relationship to one or more fluid outlet openings provided through the sidewall of the body.

In one particularly preferred form, the nozzle body has a threaded end for connection to a fluid-conveying conduit, while the slug therein is of cylindrical configuration with a conical, flow-directing end face adjacent the threaded connection of the body. In addition, the end wall of the body remote from the threaded portion is of annular configuration, such that the end face of the slug adjacent the annular end is visible to the naked eye; the appropriate coding corresponding to the performance characteristics attributable to a given slug can therefore be placed on this visible end face, such that an inspector can tell at a glance what sort of performance characteristics and discharge rates are to be expected from the nozzle. Another preferred form comprises a cylindrical slug having an inclined end wall at an angle to the axis of the slug thus serving to close one part of an equally spaced, circumferentially located, four apertured body, while an opposed port is left virtually full open while the ports on either side are only partially closed, thus permitting selective control over the spray pattern emitted from the nozzle assembly.

If it is desired to alter the operation of the nozzle, it is only necessary to employ a slug of different configuration, e.g., a slug having a cylindrical sidewall of greater or lesser length, or one with an inclined end wall of greater or less angularity.

BRIEF DESCRIPTION OF THE DRAWING

FIG. 1 is a side elevational view of one type of nozzle in accordance with the invention, shown with a slug therein of predetermined dimensions;

FIG. 2 is a bottom view of the nozzle illustrated in FIG. 1;

FIG. 3 is a vertical sectional view taken along line 3—3 of FIG. 1;

FIG. 4 is a sectional view taken along line 4—4 of FIG. 1;

FIG. 5 is an elevational view with parts broken away for clarity illustrating a nozzle in accordance with the invention attached to a fluid-conveying conduit, and with a flow-directing slug therein of different configuration than that illustrated in the embodiment of FIGS. 1–4;

FIG. 6 is an elevational view illustrating the bottom end face of the flow-directing slug depicted in FIGS. 1–4.

DESCRIPTION OF THE PREFERRED EMBODIMENTS

Figure 7:
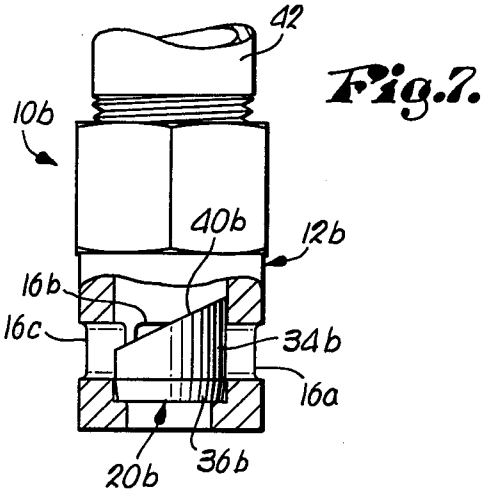
FIG. 7 is a fragmentary, side elevation view of the nozzle depicted in preceding figures and provided with another type of flow directing slug with parts being broken away and in section for clarity.

A fluid discharge nozzle 10 in accordance with the invention broadly includes an elongated, tubular body 12 having structure presenting a fluid inlet 14 and at least one fluid outlet opening 16 through the sidewall 18 of the body. A fluid flow-directing slug 20 is disposed within body 12 and has a surface thereof located in at least partial covering relationship to outlet opening 16 for cooperatively defining, along with the opening 16, a fluid outlet port 22 of predetermined effective dimensions. Also, means 24 is provided for removably supporting the slug 20 in its operative disposition, whereby the slug can be removed and replaced by a different slug of different configuration in order to alter the effective dimensions of the outlet port, as will be explained.

Body 12 is preferably formed of metallic material, and can be machined directly from hexagonal or round stock, or case or forged from aluminum, brass, bronze or other metals. As a further alternative, the body 12 may be molded of a suitable synthetic resin material such as nylon, polyethylene, polypropylene or polyvinyl chloride resin. In preferred forms, the body is of integral construction and includes a hexagonal connection end 26 having the interior thereof threaded as at 28. A substantially cylindrical portion 30 extends essentially coaxially from end 26 and is defined by sidewall 18 as illustrated. The latter includes a plurality, preferably four, of equally and circumferentially spaced outlet openings 16 (see FIG. 4). In addition, a transversely extending, annular end wall 32 forms the lowermost end of the nozzle 10 as depicted in FIGS. 1 and 3.

Slug 20 is located within the central passageway defined by the wall 18 and preferably includes a cylindrical central portion 34, an inwardly tapered lower portion 36 terminating in a transverse bottom face 38, and a conical, flow-directing end face 40 adjacent to and opposing the fluid inlet defined by the hexagonal end 26. The slug 20 is again preferably composed of rigid metallic material.

Coding or other indicia is preferably placed on end face 38 of slug 20. For purposes of illustration, the numeral "3" has been applied to the face 38 as illustrated in the drawing. In any event though, it will be seen that this marking can be seen through the central aperture defined by annular wall 32, when slug 20 is in its operative disposition. Thus, when nozzle 10 is installed, an inspector can visually determine the performance characteristics of the nozzle simply by inspecting the underside thereof.

Slug 20 is preferably located within body 12 in such manner that the outer defining sidewall of cylindrical portion 34 is in partial covering relationship to the spaced outlet openings 16. In this fashion a plurality of corresponding outlet ports 22 are cooperatively defined by the slug and the openings 16. In addition, the conical face 40 of slug 20 is tapered toward the ports 22, thus serving to direct fluid from the interior of body 12 out the ports 22.

FIG. 5 illustrates a second embodiment **10*a* of the invention. In this case the body 12 is identical with that described in connection with FIGS. 1–4, and thus need not be further discussed. However, nozzle 10*a* is provided with a slug 20*a* of somewhat different configuration than the earlier described slug 20. In essence, slug 20*a* differs from slug 20 in that the former has a cylindrical portion 34*a* which is of lesser vertical length than that of the slug 20. The bottom portion 36*a*, face 38*a*, and conical end 40*a* are identical with corresponding parts 36, 38 and 40 of the slug 20**.

As will be readily appreciated, provision of the somewhat smaller slug **20*a* serves to define, along with the opening 16, outlet ports 22*a* of somewhat larger effective dimensions, particularly in the vertical extent thereof. Thus, use of slug 20*a*, as opposed to slug 20, serves to create a situation wherein the discharge rate of fluid would be increased. Accordingly, the coding provided on the face 38*a* of slug 20*a* would be different than that on slug 20**, so as to reflect the difference in performance and discharge characteristics. It will also be understood that other design changes can be made in a particular slug; e.g., the taper of the conical end face can be altered.

Figure 8:
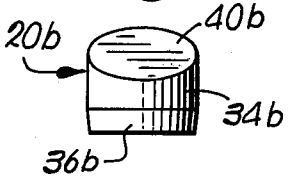
FIG. 8 is a side elevational view of the slug shown in FIG. 7 and removed from the nozzle body.

An exemplary modified form of nozzle structure embodying the basic concept of this invention is illustrated in FIGS. 7 and 8 wherein nozzle **10*b* has a body 12*b* which is identical to that shown in FIG. 1 but in this instance one entirely different slug 20*b* is removably positioned in the bore of body 12*b*. Slug 20*b* is of generally cylindrical shape wherein the cylindrical sidewall 34*b* merges into a conical lower section 36*b* which is similar to the section 36 of slug 20. The upper planar face 40*b* of slug 20*b* is at angle with respect to the longitudinal axis of sidewall 34*b* to thereby permit gas to escape fully from one of the ports or openings 16*b*** while blocking the opposed nozzle opening and partially blocking the opposed side opening relative thereto.

In the use of any of the nozzle structures in accordance with the invention, the threaded end 26 of the body 12 is simply threaded onto a fluid conveying pipe or conduit 42. In the case of a fire extinguishing apparatus, pipe 42 would be designed to convey fluid fire extinguishant from the supply thereof. If it would become necessary to alter the performance characteristics of the apparatus, it is only necessary to remove body 12 from pipe 42, remove the slug then in place, and replace it with a different slug of different configuration, whereupon the body 12 can then be threaded back onto the pipe 42.

In use when a fire is detected, the apparatus actuates, thereby serving to rapidly propel the extinguishant through the pipe 42 and into the nozzle structure. At this point the extinguishant strikes the conical portion of the slugs 10 and **10*a* on the inclined planar portion of slug 10*b* and is diverted generally outwardly through the corresponding outlet ports. Slugs 10 and 10*a* provide substantially circular spray patterns for the extinguishant as it leaves the nozzle structure while nozzle 10*b*** gives a spray pattern through an arc of about 180°.

In the case of nozzle assembly **10*b*, it can be seen from FIG. 7 that the slug 20*b* completely blocks one of the openings 16*a*, only partially blocks the two opposed openings 16*b*, and allow unimpeded suppresant flow through the opening 16*c***.

Figure 9:
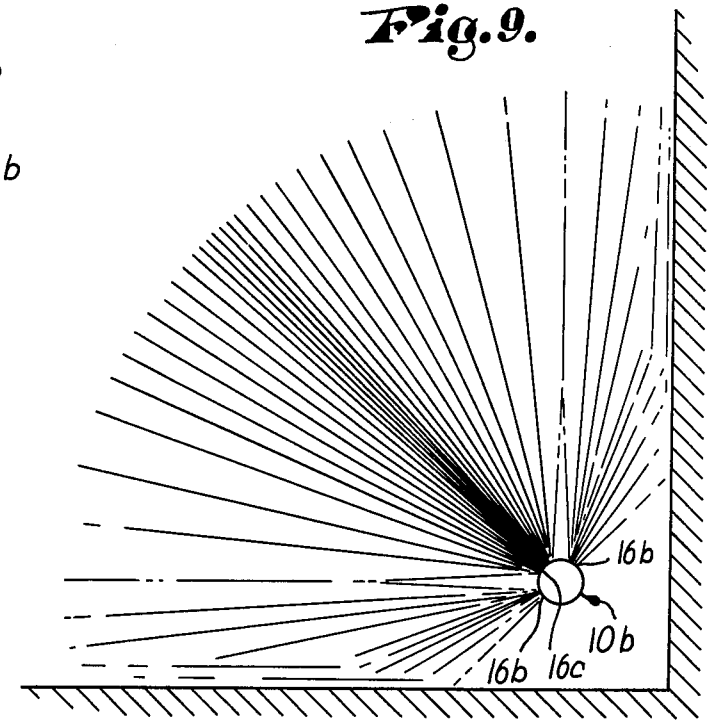
FIG. 9 is a diagrammatic representation of the flow pattern obtained during use of the nozzle assembly of FIG. 7 in a corner installation.
Figure 10:
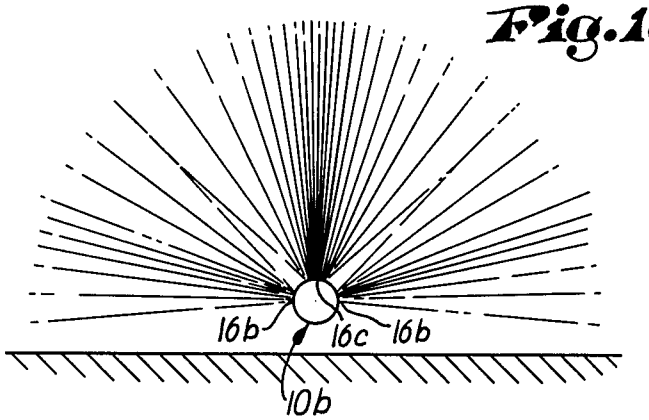
FIG. 10 is a diagrammatic showing similar to FIG. 9 but illustrating disposition of the nozzle assembly of FIG. 7 along a wall spaced from a corner.

Nozzle assembly **10*b* has greatest utility for corner or wall applications as depicted in FIGS. 9 and 10 wherein it is not desired that the spray be emitted in a 360° pattern as is the case with the nozzles of FIGS. 1–6 inclusive. Note from FIGS. 9 and 10 that the heaviest spray concentration is from the unblocked opening 16*c* while the spray decreases as the portions of openings 16*b* toward opening 16*a* are approached. The total spray pattern is essentially 180°. One particular feature of nozzle assembly 10*b* is the fact that slug 20*b* may be rotated in body 12*b* as desired to give the required spray dispersion. This is important for a number of reasons including the need to accomodate threading of nozzle body 12*b* onto a suitable supply pipe 42**.

Having thus described the invention, what is claimed as new and desired to be secured by Letters Patent is:

1. A fluid discharge nozzle comprising:

an elongated, tubular body having structure presenting a fluid inlet and a plurality of circumferentially spaced outlet openings through the sidewall of the body at a point spaced from said inlet;

a fluid flow-directing slug disposed within said body and having a surface means thereon located in simultaneous partial covering relationship to corresponding outlet openings for cooperatively defining, along with said outlet-presenting structure, a plurality of fluid outlet ports of predetermined effective dimensions; and means for removably supporting said slug in said disposition whereby said slug can be removed and be replaced by a different slug of different configuration so as to alter the effective dimensions of respective outlet ports.

2. The nozzle as set forth in claim 1 wherein said slug is a solid body including a cylindrical sidewall and a conical, flow-directing end face adjacent said inlet.

3. The nozzle as set forth in claim 1 wherein said slug-supporting means comprises a ledge means integral with said body.

4. The nozzle as set forth in claim 3 wherein said ledge means includes an annular end wall extending transversely relative to the longitudinal axis of the body, said slug having the end face thereof remote from said inlet in engagement with said annular end wall.

5. The nozzle as set forth in claim 1 wherein said body has, in cross section, a substantially circular inner defining wall surface.

6. The nozzle as set forth in claim 1 wherein said surface of the slug is inclined at an angle relative to the longitudinal axis of the slug and is of generally planar configuration.

7. The nozzle as set forth in claims 1 or 6 wherein said slug is of a length relative to the body and the surface is at an angle to cause the slug to substantially completely block one of the openings, only partially block one or more other openings, and leave still another opening unblocked.

8. The nozzle as set forth in claim 7 wherein said openings are spaced about 90° apart.

* * * * *